US006446698B1

(12) United States Patent
Soderstrom et al.

(10) Patent No.: US 6,446,698 B1
(45) Date of Patent: Sep. 10, 2002

(54) INVESTMENT CASTING WITH EXOTHERMIC MATERIAL

(75) Inventors: Mark L. Soderstrom, Fruitport; John Brinegar, Muskegon, both of MI (US)

(73) Assignee: Howmet Research Corporation, Whitehall, MI (US)

( * ) Notice: Subject to any disclaimer, the term of this patent is extended or adjusted under 35 U.S.C. 154(b) by 3 days.

(21) Appl. No.: 09/804,404

(22) Filed: Mar. 12, 2001

(51) Int. Cl.[7] ..... B22D 23/00; B22D 27/00; B22D 7/10; B22C 9/08; B22C 9/02

(52) U.S. Cl. ..... 164/53; 164/57.1; 164/123; 164/360; 164/361

(58) Field of Search ..... 164/53, 55.1, 57.1, 164/361, 359, 360, 54; 249/86

(56) References Cited

U.S. PATENT DOCUMENTS

| | | | | |
|---|---|---|---|---|
| 865,562 A | | 9/1907 | Brabrook | |
| 1,116,899 A | | 11/1914 | Lindemuth | |
| 1,294,209 A | | 2/1919 | Walker | |
| 2,205,327 A | | 6/1940 | Williams | 22/129 |
| 2,280,833 A | | 4/1942 | Kinzel | 22/216 |
| 2,295,227 A | | 9/1942 | Mackett, Jr. | 22/134 |
| 2,305,477 A | | 12/1942 | Junghans | 22/200.1 |
| 2,334,701 A | | 11/1943 | Galvin et al. | 22/134 |
| 2,335,008 A | | 11/1943 | Hites | 22/134 |
| 2,513,602 A | | 7/1950 | Udy | 22/147 |
| 2,514,793 A | | 7/1950 | Pletsch et al. | 22/215 |
| 3,467,172 A | | 9/1969 | Clem | 164/338 |
| 3,512,572 A | | 5/1970 | Ednell | 164/41 |
| 3,566,952 A | | 3/1971 | Lane | 164/120 |
| 3,754,592 A | * | 8/1973 | Mullen | 164/122.1 |
| 3,769,046 A | | 10/1973 | Sprinkle et al. | 106/38.22 |
| 4,046,187 A | | 9/1977 | Matsuyama et al. | 164/53 |
| 4,398,588 A | | 8/1983 | Hamill, Jr. et al. | 164/53 |
| 4,467,858 A | | 8/1984 | Trinkl et al. | 164/360 |
| 4,566,518 A | | 1/1986 | Kawamura et al. | 164/53 |
| 4,651,799 A | | 3/1987 | Chandley | 164/35 |
| 4,773,467 A | * | 9/1988 | Graham et al. | 164/122.1 |
| 5,048,591 A | * | 9/1991 | Oti et al. | 164/122.1 |
| 5,062,469 A | | 11/1991 | Monte et al. | 164/122.2 |
| 5,072,771 A | * | 12/1991 | Prasad | 164/122.1 |
| 5,271,451 A | | 12/1993 | Chandley et al. | 164/63 |

* cited by examiner

*Primary Examiner*—M. Alexandra Elve
*Assistant Examiner*—Kevin McHenry

(57) ABSTRACT

Method and investment shell mold for casting comprising introducing molten metallic material into an investment shell mold to fill a mold cavity and provide an upper surface of the molten metallic material above the mold cavity. An initially closed, destructible region of the mold then is broken to provide an entry opening through which exothermic material is placed on the upper surface of the molten metallic material to provide a source of molten metallic material to accommodate shrinkage of a casting as it solidifies in the mold cavity.

12 Claims, 3 Drawing Sheets

INVESTMENT CASTING WITH EXOTHERMIC MATERIAL

BACKGROUND OF THE INVENTION

The present invention relates to casting of molten metallic material in an investment mold with an exothermic material placed on the molten metallic material subsequent to introduction of the molten metallic material in the mold.

BACKGROUND OF THE INVENTION

Exothermic material has been employed in the casting art to provide supplemental heat to molten metallic material present in a riser of a sand mold while the molten metallic material in one or more mold cavities solidifies. The molten metallic material in the riser is fed to the solidifying casting (s) in the mold cavities to avoid shorts and other void-type defects resulting from casting shrinkage and lack of adequate supply of molten metallic material during solidification. U.S. Pat. Nos. 2,295,227 and 3,467,172 describe sand molds having exothermic material placed in the sand mold prior to casting of a molten metallic material, such as steel therein.

Exothermic material has been used in making castings wherein molten metallic material is cast into a ceramic investment shell mold made by the well known lost-wax process. For example, a ceramic investment shell mold is formed having a primary or secondary frusto-conical pour cup that includes pre-existing top opening to receive exothermic material on the molten metallic material after it is cast into the mold up to the level or height of the primary or secondary pour cup. This technique limits the locations where exothermic material can be applied on the molten metallic material in the mold and the effectiveness of the exothermic material in making large castings. This technique is further disadvantageous in that a significant excess of molten metallic material is required to fill the primary or secondary pour cup than is necessary to make the casting(s). Moreover, if a secondary pour cup is provided on the mold to receive exothermic material, the additional pre-existing opening (open secondary pour cup) provides an additional potential source for foreign material, such as inclusions, to enter the mold as it handled prior to casting. In addition, the technique is not applicable to investment shell molds that include an inverted loop feedgate of the type described in U.S. Pat. No. 6,019,158 where the molten metallic material is caused to flow upwardly under pressure from a pour cup reservoir through an inverted feedgate passage into the mold cavities.

It is an object of the present invention to provide method and apparatus for casting of a molten metallic material in an investment mold in a manner that exothermic material can be applied on the surface of the molten metallic material subsequent to its being introduced into the mold.

SUMMARY OF THE INVENTION

The present invention provides a method as well as investment mold for casting of molten metallic material wherein a refractory shell mold includes a first opening, such as for example a pour cup opening, to receive a molten metallic material to fill a mold cavity. Molten metallic material is introduced into the shell mold through the first opening to fill the mold cavity and provide an upper surface of the molten metallic material in the mold below an initially closed, destructible region of the mold. The initially closed, destructible region is destroyed to provide an entry opening into the mold through which an exothermic material is placed on the upper surface of the molten metallic material in the mold to provide a source of molten metallic material above the mold cavity to be fed thereto to accommodate shrinkage of a casting as it solidifies in the mold cavity.

In an embodiment of the invention, the molten metallic material is introduced into the shell mold such that the upper surface of the molten metallic material resides in a reservoir disposed below an open pour cup. The destructible region of the mold is communicated to the reservoir. In another embodiment of the invention, the destructible region can comprise a blind riser that is communicated to the reservoir and that is broken off after the molten metallic material is cast into the mold.

The present invention aids in feeding of one or more mold cavities with molten metallic material heated by the exothermic material after the mold is cast with less molten metallic material than is required to fill the mold to the level of the pour cup. The invention can be practiced with a variety of investment shell molds including those having an inverted loop feedgate. The entry opening into the mold is made only after the molten metallic material is introduced into and fills the mold cavities.

The above objects and advantages of the invention will become more readily apparent from the following detailed description taken with following drawings.

DETAILED DESCRIPTION OF THE INVENTION

Figures 1, 2, 3:
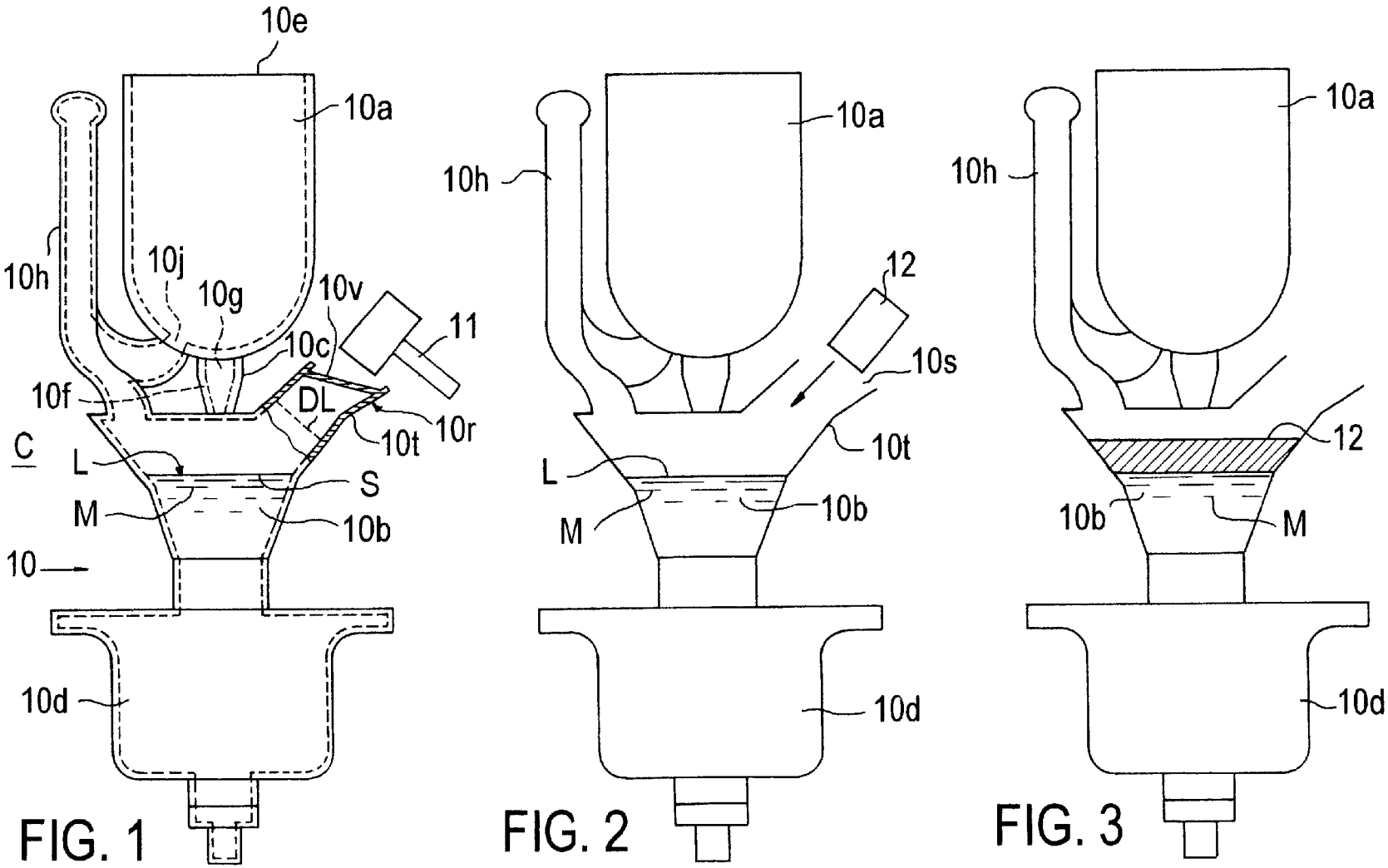
FIG. 1 is a schematic elevational view of an investment shell mold pursuant to an embodiment of the invention.
FIG. 2 is similar to FIG. 1 after the destructible region of the mold has been broken to provide an entry opening for exothermic material.
FIG. 3 is similar to FIG. 2 showing the exothermic material placed to cover an uppermost surface of the molten metallic material in the mold.
Figure 4:
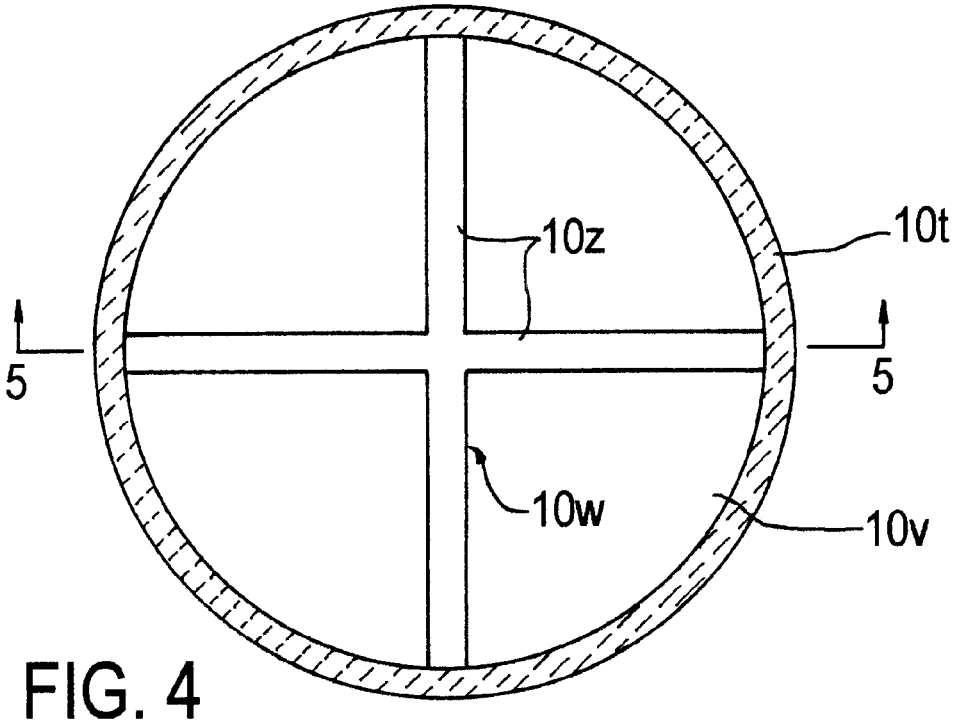
FIG. 4 is an end view of an initially closed, breakable region of the mold taken in the direction of lines 4—4 of FIG. 5 having a stress concentrator in the form a cross or X mark groove.
Figure 5:
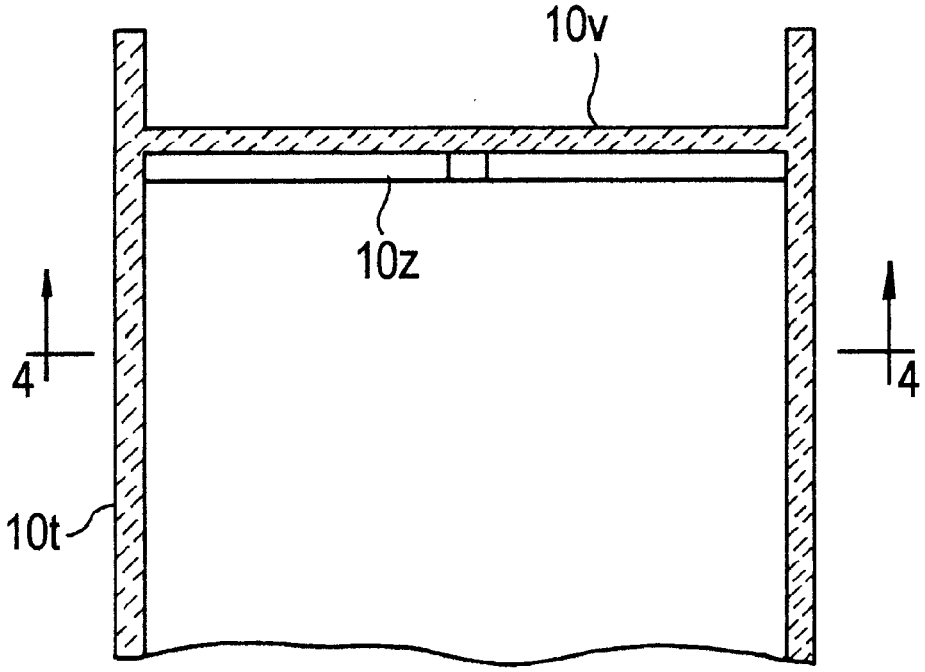
FIG. 5 is a partial sectional view of the initially closed, breakable region of the-mold taken along lines 5—5 of FIG. 4.

The present invention provides method and apparatus for casting of metals and alloys (metallic materials) and is especially useful in investment casting of nickel, cobalt and iron base superalloys with equiaxed, single crystal, columnar or equiaxed grain microstructures as well as titanium and its alloys and other commonly used metal and alloys. The present invention can be practiced to make equiaxed grain castings which may be cored or not to produce complex internal passages therein using conventional casting equipment.

Referring to FIGS. 1–5, a ceramic investment shell mold 10 pursuant to an illustrative embodiment of the invention is shown including an upper open pour cup 10*a* communicated to a frustoconical shaped reservoir 10*b* by an inverted loop feedgate passage 10*h*. The reservoir 10*b* is disposed above and communicated to a mold cavity 10*d* having a shape of an article to be cast. Although the mold 10 is shown as including a single mold cavity 10*d*, a plurality of mold cavities can be provided in the mold 10 as is well known and can be supplied with the molten metallic material from one or more reservoirs and/or one or more sprues or runners communicated to a single reservoir 10*b*. The pour cup 10*a* is connected to the reservoir 10*b* by a support post 10*c* which comprises a passage 10*f*formed integrally with the pour cup and then plugged by a ceramic plug log so that the molten metallic material in the pour cup 10*a* cannot flow therethrough.

The open pour cup 10*a* has a top opening 10*e* through which a molten metallic material can be introduced from a melting crucible (not shown) for example only. The pour cup communicates via a lower opening 10*j* to an inverted loop feedgate passage 10*h* of the type described in U.S. Pat. No. 5,975,188 and copending application Ser. No. 09/441,259 filed Nov. 16, 1999, the teachings of both of which are incorporated herein by reference. The inverted loop feedgate passage 10*h* in turn is communicated to the reservoir 10*b* that is communicated to the mold cavity 10*d*. Molten metal can be introduced in the pour cup or as a solid metallic charge melted therein as described in copending application Ser. No. 09/441,259. The invention is not limited to practice using an inverted loop feedgate 10*h* and can be practiced with any feed gating that can convey molten metallic material from the pour cup 10*a* to the mold cavity 10*d*.

After the molten metallic material is introduced or melted in the pour cup 10*a*, gas pressure is applied to the molten metallic material in the pour cup 10*a* as described in above U.S. Pat. No. 5,975,188 and above copending application Ser. No. 09/441,259 and flows through the inverted loop feedgate passage 10*h*, into the reservoir 10*b* and then into the mold cavity 10*d* to fill it with the molten metallic material that is solidified to form the cast article in the mold cavity. For example, an inert gas pressure can be established in casting chamber C in which the shell mold 10 is disposed to force the molten metallic material to flow from the pour cup through the inverted loop feedgate into the reservoir and the mold cavity. The shell mold can include a refractory glaze on its exterior surface to reduce permeability to the inert gas in chamber C as described in copending application Ser. No. 09/441,259. The amount of molten metallic material introduced into the mold 10 is sufficient to provide an upper surface S of the molten metallic material at a height or level L in the reservoir 10*b*. The level L of the upper surface S of the molten metallic material in the reservoir 10*b* is below the pour cup 10*a*, FIGS. 1–3. The molten metallic material M in the reservoir 10*b* thereby provides a source of molten metallic material that can be fed as necessary to the mold cavity 10*d* to counter shrinkage of the cast article during its solidification therein as described further below. The level L of the molten material in reservoir 10*b* provides a metallostatic head to this end.

Pursuant to the invention, the investment shell mold 10 includes an initially closed, destructible region 10*r* that is disposed above the mold cavity 10*d* and the level L of upper surface S in the reservoir 10*b*. The initially closed, destructible region 10*r* is destructible or breakable to provide an entry opening 10*s*, FIG. 2, into the shell mold reservoir 10*b* above the level L of the upper surface S of the molten metallic material in the reservoir 10*b*.

The initially closed, destructible region 10*r* is illustrated as comprising a tubular extension 10*t* formed integrally with the mold 10 and projecting upwardly from reservoir 10*b* at an angle relative to horizontal and terminating in a breakable end cap or closure 10*v*. The end cap or closure 10*v* is rendered readily breakable by including a stress concentrator 10*w*, such as a cross or x-shaped groove 10*z*, FIGS. 4–5, to assist in breakage thereof when struck with an object, such as a hammer 11 illustrated in FIG. 1. The stress concentrator 10*w* can comprise any suitable shape that will render the end cap or closure 10*v* readily breakable by striking with an object. For example, in lieu of groove 10*z*, the stress concentrator may comprise one or more raised ribs on the end cap or closure 10*v*. Moreover, the destructible region 10*r* is not limited to having a breakable end cap or closure 10*v* as the tubular extension 10*t* itself may be broken off at a location along its length. For example, a peripheral notch or groove represented by dashed line DL in FIG. 1 may be formed about the tubular extension 10*t* to act as a stress concentrator to assist in locating and breaking off of the tubular extension to this end. Also see FIG. 6 where a peripheral notch 21' is provided on tubular mold riser 10*br'* to this same end.

The investment shell mold 10 typically is made with the mold features described above by the well known lost wax process wherein a wax or other fugitive pattern having the above described mold features is dipped repeatedly in ceramic slurry, drained, stuccoed with coarse ceramic stucco, and air dried to build up the desired shell mold thickness (e.g. a typical shell mold wall thickness in the range of ¼ to 1 inch) on the pattern. The destructible region 10*r* of the mold typically will have the same wall thickness as the remainder of the mold as a result, although the invention envisions controlling the build-up of ceramic slurry and stucco on the pattern regions forming the destructible region 10*r* to produce a reduced shell wall thickness at the destructible region 10*r* to facilitate breakage of the end cap or closure 10*v* or the tubular extension 10*t* itself as described above. For example, a maskant can be applied after application of the first several ceramic layers on the fugitive pattern to prevent further shell build up at region 10*r* while remaining ceramic layers are built-up at other regions of the shell mold 10. The end cap 10*v* can be formed integrally with the shell mold 10, or it can be a preformed cap member incorporated on the shell mold extension 10*t* during or after the lost wax process mold forming process. The ceramic slurry and ceramic stucco employed to fabricate the mold will depend on the metal or alloy to be cast therein as those skilled in the art will appreciate. The pattern then is removed from the invested shell mold, and the shell mold is fired at elevated temperature to develop adequate mold strength for casting.

After the initially closed, destructible region 10*r* is destroyed or broken to provide entry opening 10*s* into the shell mold reservoir 10*b*, an exothermic material 12 in the form of a bagged or briquette material is placed manually in the reservoir 10*b* on the upper surface S of the molten metallic material in the reservoir 10*b* such that the exothermic material covers the surface S, FIG. 3. The exothermic material 12 can comprise any conventional exothermic material that, when ignited by the heat of the mold, will exhibit an exothermic reaction to release heat to the molten metallic material in the reservoir 10*b* to heat it and maintain the molten metallic material in the reservoir in the molten state above the mold cavity 10*d* as the casting therein solidifies and undergoes shrinkage. The molten metallic material M heated by the exothermic material 12 thus comprises a source of molten material that can be fed to the mold cavity 10*d* as the casting therein solidifies to accommodate usual shrinkage experienced by the casting.

An illustrative exothermic material 12 that can be used in practice of the invention comprises Ferrux CP9543 exothermic material available from Foseco Corporation, Cleveland, Ohio. However, the invention is not limited to this particular exothermic material and can be practiced using other conventional exothermic materials that release heat when ignited.

Figure 6:
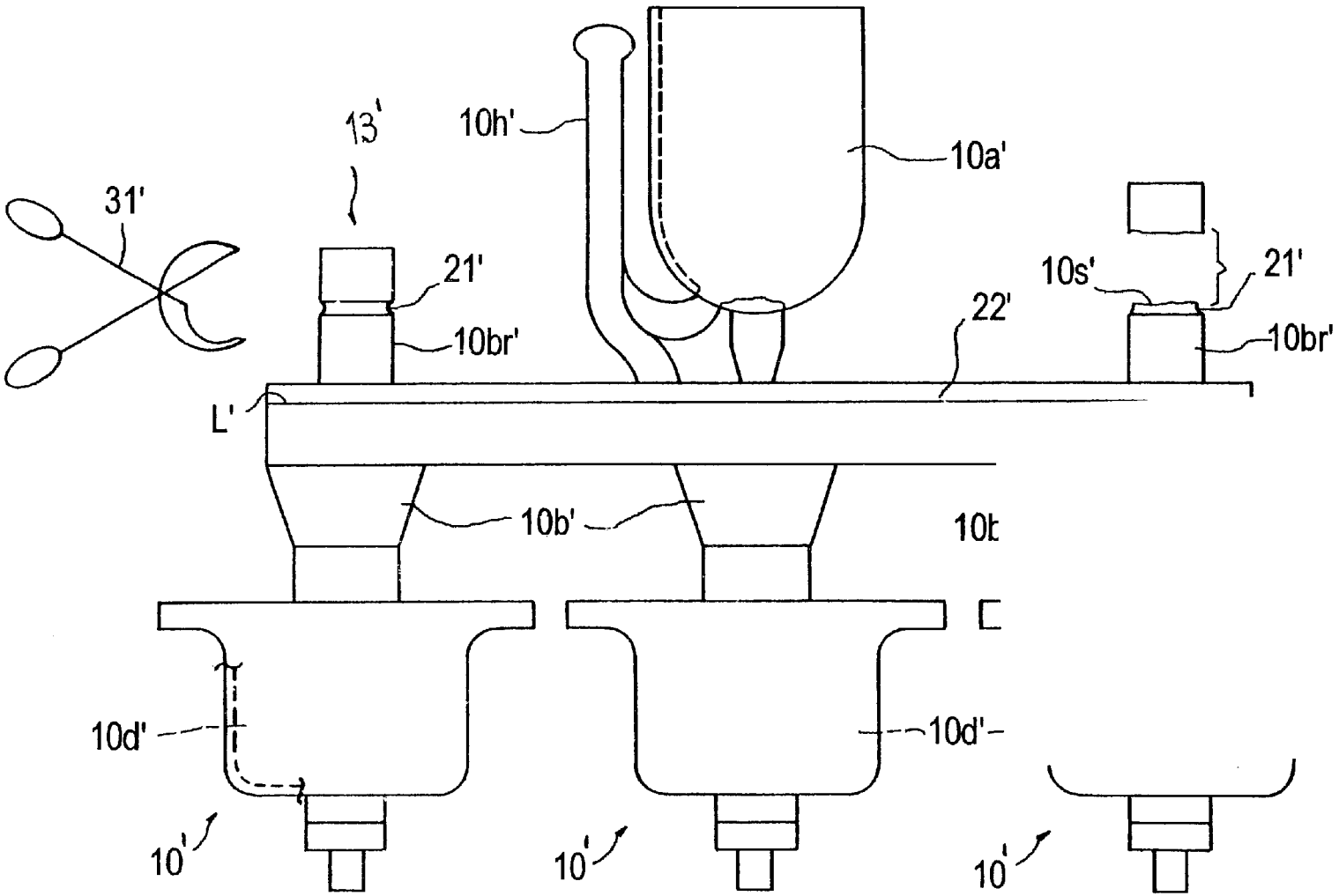
FIG. 6 is a schematic elevational view of an investment shell mold assembly pursuant to another embodiment of the invention.

FIG. 6 illustrates another embodiment of the invention where like features of FIGS. 1–3 are represented by like reference numeral primed. In lieu of single investment shell mold 10 of FIGS. 1–3, FIG. 6 shows a gang or cluster mold assembly 13' having a common pour cup 10*a'* to supply molten metallic material to an inverted loop feedgate passage 10*h'* when the molten metallic material in the pour cup is subjected to gas pressure. The molten metallic material flows through the passage 10*h'* into a runner passage 22' that feeds the molten metallic material to a reservoir 10*b'* above each of a plurality of shell molds 10' each having a mold cavity 10*d'* therein. The molten metallic material is shown filling the reservoirs 10*b'* and runner passage 22' to level L', although the level L' of molten metallic material may reside only in each reservoir 10*b'* and not extend into runner passage 22' depending upon the quantity of molten metal introduced into the shell mold.

The runner 22' includes a respective initially closed, destructible region comprising a blind riser 10*br'* that is formed integral with the mold assembly. A blind riser 10*br'* is cooperably associated on the runner passage 22' above each mold cavity 10*d'*, although the blind riser for the middle mold 10' is not shown for convenience in FIG. 6.

Each blind riser 10*br'* includes a peripheral notch 21' providing a stress concentrator that is broken off using a tool 31' such as a plier-type gripper that is manually caused to grip the notch and break off the blind riser 10*br'* at the notch 21' as illustrated for the right hand blind riser 10*br'* in FIG. 6. The blind risers 10*br'* are broken off after the molten metallic material is cast into the molds 10' to provide entry openings 10*s'* by which exothermic material can be placed on the upper surface of the molten metallic material in the runner passage 22' or in the reservoirs 10*b'* depending upon the molten metal fill level; i.e. whether level L' resides in runner passage 22' as shown or in each reservoir 10*b'*.

The present invention is advantageous to provide feeding of molten metallic material heated by the exothermic material after the mold is cast with less molten metallic material than is required to fill the mold to the level of the pour cup. The invention can be practiced with a variety of investment shell molds including those having an inverted loop feedgate. The entry opening 10*s* into the mold is made only after the molten metallic material is introduced into and fills the mold cavity, thereby eliminating entry opening 10*s* as a path for intrusion of foreign material such as inclusions into the mold while the mold is being handled prior to casting. Entry opening 10*s* is formed only after the molten metallic material is introduced into the mold and fills the mold cavity 10*d* and reservoir 10*b* as described above. Any mold material entering the reservoir 10*b* when the entry opening 10*s* is formed (e.g. by breaking end cap or closure 10*v*) will float on the molten metallic material in the reservoir and not enter the mold cavity.

It is to be understood that the invention has been described with respect to certain specific embodiments thereof for purposes of illustration and not limitation. The present invention envisions that modifications, changes, and the like can be made therein without departing from the spirit and scope of the invention as set forth in the following claims.

We claim:

1. Method of casting, comprising introducing molten metallic material into a shell mold through an opening to fill a mold cavity and provide an upper surface of the molten metallic material in said mold above said mold cavity and below an initially closed, destructible region of said mold, destroying said initially closed, destructible region after said molten metallic material is introduced in said mold to provide an entry opening into the mold above said upper surface, and placing exothermic material on said upper surface via said entry opening.

2. The method of claim 1 wherein the molten metallic material is introduced into said mold through an open pour cup of said mold.

3. The method of claim 2 wherein the molten metallic material is poured into the open pour cup and flows into a reservoir below said pour cup and then into a mold cavity below said reservoir.

4. The method of claim 3 wherein the upper surface of the molten metallic material resides in said reservoir below said pour cup and above said mold cavity.

5. The method of claim 1 wherein said destructible region of the mold comprises a breakable region communicated to said reservoir.

6. The method of claim 1 wherein said destructible region is struck with an object to break it open.

7. The method of claim 6 wherein said destructible region includes a stress concentrator to assist in breakage thereof when struck.

8. The method of claim 1 wherein said destructible region comprises a blind riser that is integral to the mold and that is broken off after the molten metallic material is introduced into the mold.

9. Combination of a) a shell mold having a mold cavity, an opening to receive a molten metallic material to fill said mold cavity and an initially closed, destructible region that is disposed above said mold cavity and that has been destroyed to provide an entry opening into the mold disposed above said mold cavity and above an upper surface of said molten metallic material in said mold, and b) exothermic material placed on said upper surface through said entry opening to provide a source of said molten metallic material above said mold cavity.

10. The combination of claim 9 wherein said opening to receive said molten metallic material comprises a pour cup of said mold.

11. The combination of claim 10 wherein said mold includes a reservoir for molten metallic material disposed below said pour cup and above said mold cavity, said destructible region being communicated to said reservoir.

12. The combination of claim 11 wherein said destructible region comprises a tubular extension projecting from said reservoir.

* * * * *